US011133570B2

(12) United States Patent
Kuo et al.

(10) Patent No.: US 11,133,570 B2
(45) Date of Patent: Sep. 28, 2021

(54) HOLDER FOR ANTENNAS

(71) Applicant: ARCADYAN TECHNOLOGY CORPORATION, Hsinchu (TW)

(72) Inventors: Shin-Lung Kuo, Kaohsiung (TW); Shih-Chieh Cheng, Tainan (TW); Sheng-Chung Chen, Hsinchu County (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 16/813,894

(22) Filed: Mar. 10, 2020

(65) Prior Publication Data

US 2020/0295438 A1 Sep. 17, 2020

(30) Foreign Application Priority Data

Mar. 15, 2019 (TW) ..... 108108880

(51) Int. Cl.

| | |
|---|---|
| ***H01Q 1/24*** | (2006.01) |
| ***H01Q 21/20*** | (2006.01) |
| ***H01Q 21/28*** | (2006.01) |

(52) U.S. Cl.
CPC ..... *H01Q 1/24* (2013.01); *H01Q 21/205* (2013.01); *H01Q 21/28* (2013.01)

(58) Field of Classification Search
CPC ..... H01Q 1/24; H01Q 1/243; H01Q 21/205; H01Q 21/28
See application file for complete search history.

(56) References Cited

U.S. PATENT DOCUMENTS

| | | | | |
|---|---|---|---|---|
| 9,768,513 | B2 * | 9/2017 | Lee | H01Q 1/2291 |
| 2008/0231519 | A1 * | 9/2008 | Yang | H01Q 1/243 343/702 |

* cited by examiner

*Primary Examiner* — Hoang V Nguyen
(74) *Attorney, Agent, or Firm* — Locke Lord LLP; Tim Tingkang Xia, Esq.

(57) ABSTRACT

A holder for antennas includes at least one circuit board, at least one carrier and at least one antenna. The at least one carrier, disposed to a lateral side of the at least one circuit board, has at least one honeycomb structure. The at least one antenna, disposed at the at least one carrier, is electrically connected with the at least one circuit board. The antenna, the carrier and the circuit board are formed as a modular structure beneficial to be assembled into or disassembled from the casing of the electronic device.

8 Claims, 4 Drawing Sheets

HOLDER FOR ANTENNAS

CROSS REFERENCE TO RELATED APPLICATION

This application claims the benefits of Taiwan application Serial No. 108108880, filed on Mar. 15, 2019, the disclosures of which are incorporated by references herein in its entirety.

TECHNICAL FIELD

The present disclosure relates in general to a holder for antennas, and more particularly to a holder for antennas that mounts the antennas to the carrier and integrates a circuit board to form a easy-disassembled modular structure.

BACKGROUND

Since a trend for the electronic device is to be miniaturized, thus it is definite a big challenge for components such as the antenna and the circuit board, to be arranged inside the casing of the electronic device.

To an electronic device having an antenna such as a mobile phone, a notebook computer, a tablet computer, even a wireless access point (AP) and the like wireless communication device, the antenna is usually disposed on the circuit board, and mostly inside the casing of the electronic device.

Regarding various methods for the antenna to be disposed on the circuit board, to some of the electronic devices, for existence of a plurality of circuit boards to be mounted separately inside the casing, thus, if an antenna is to be mounted on the circuit board, structural interference among these circuit boards would affect signal receiving and transmitting of the antenna.

Further, in view of dimensions and sizes of the circuit boards, sometimes the antenna can't be properly mounted on the circuit board.

In addition, regarding existing methods for the antenna to be disposed inside the casing of the electronic device, a supportive carrier structure is usually necessary for the antenna to be disposed inside the casing. After the antenna is fixed (via adhering for example) to the carrier structure, then connecting lines and connectors are introduced to electrically connect the antenna and the circuit boards.

Nevertheless, one of major conventional disadvantages for disposing the antenna is that, when the circuit board or the antenna is to be assembled/disassembled, the circuit board and the antenna shall be disposed separately. Otherwise, the connecting lines and the connectors are vulnerable to be broken. In the art, the electronic device having the aforesaid antenna generally has multiple separate antennas, and thus plenty of labor time would be spent while in assembling and/or disassembling the antenna, the connecting lines and the connectors.

Accordingly, an improvement upon the aforesaid type of electronic device to provide a holder for antennas that can mount the antennas onto a carrier and thus a circuit board so as to form a modular structure for facilitating assembling and/or disassembling of a related casing is definitely welcome and urgent to the skill in the art.

SUMMARY

In this disclosure, an embodiment of a holder for antennas includes:

at least one circuit board;

at least one carrier, disposed to a lateral side of the at least one circuit board, having at least one honeycomb structure; and at least one antenna, disposed at the at least one carrier, electrically connected with the at least one circuit board.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
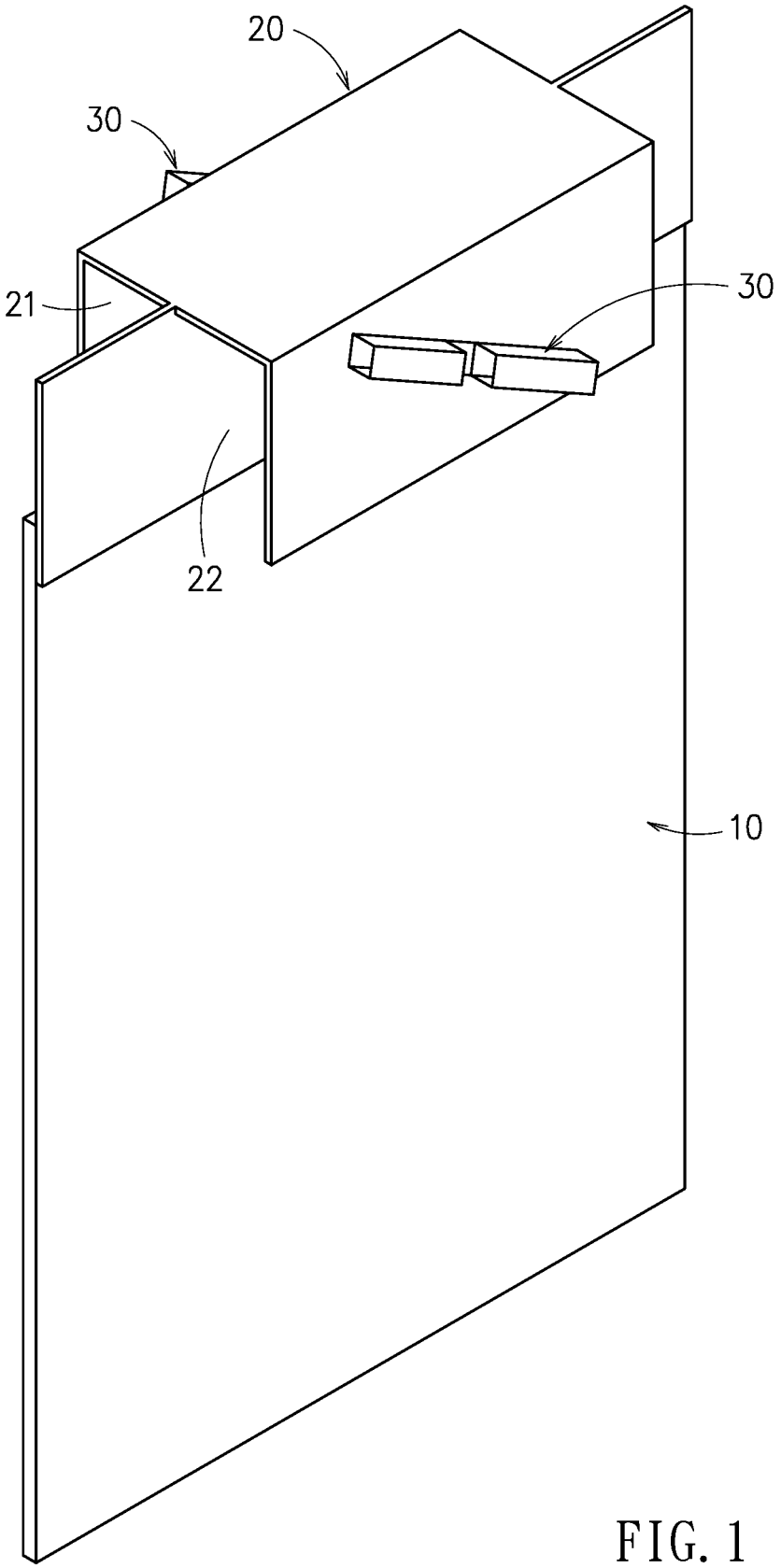
FIG. 1 is a schematic perspective view of an embodiment of the holder for antennas in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Referring now to FIG. 1, this embodiment of the holder for antennas includes a circuit board 10, a carrier 20 and two antennas 30.

As shown, the carrier 20 is disposed to a top lateral side of the circuit board 10. Yet, practically and mostly per requirements, the carrier 20 can be disposed to any lateral side of the circuit board 10. The carrier 20 has two honeycomb structures 21, 22. In this embodiment, these two honeycomb structures 21, 22 are disposed to opposing sides of the carrier 20. Material for the carrier 20 is not limited, and can be a conductive material or a non-conductive material. The carrier 20 can be locked, riveted, clamped or glued to the circuit board 10.

The two antennas 30 are disposed on the carrier 20. In this embodiment, the two honeycomb structures 21, 22 are located symmetrically to two opposing sides of the carrier 20, and thus each of the two honeycomb structures 21, 22 can be used to mount one antenna 30. Though, in FIG. 1, the two the antennas 30 are disposed exterior to the respective honeycomb structures 21, 22, yet, according to this disclosure, the two antennas 30 can be both disposed interior to the respective honeycomb structures 21, 22, or disposed in a manner of one exterior and interior to the respective honeycomb structures 21, 22.

In this disclosure, the antenna 30 can be mounted to the carrier 20 in any relevant manner. In the case that the antennas 30 and the carrier 20 are separate members, the antennas 30 can be adhered to the carrier 20. In the case that the carrier 20 is a conductive material, then the antenna 30 can be mounted onto the carrier 20 by laser engraving or by printing, so that the antennas 30 and the carrier 20 can be integrated as a unique piece.

The antennas 30 and the circuit board 10 are electrically connected. In this embodiment, the antennas 30 and the circuit board 10 are electrically coupled in a wireless manner.

As shown in FIG. 1, the antennas 30, the carrier 20 and the circuit board 10 are integrated as a modular structure, which is beneficial for assembling and disassembling with the casing of the electronic device (not shown in the figure).

Figure 2:
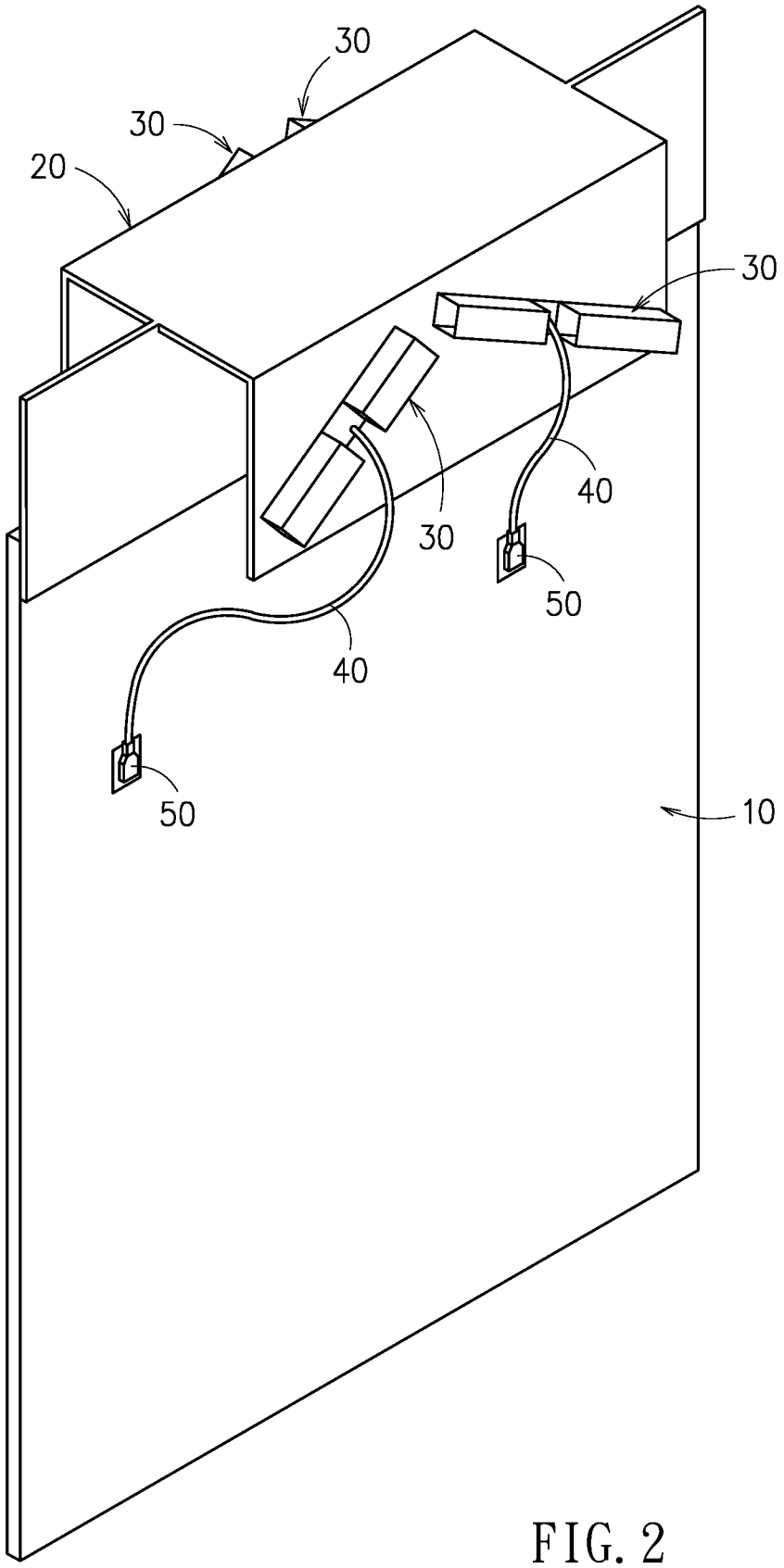
FIG. 2 is a schematic perspective view of another embodiment of the holder for antennas in accordance with this disclosure.

Referring now to FIG. 2, in this embodiment, each of the two honeycomb structures 21, 22 of the carrier 20 is furnished with two antennas 30, i.e., four antennas 30 totally. A connecting line 40 is introduced to connect the antenna 30 and the circuit board 10. One end of the connecting line 40 is connected with the antenna 30, while another end thereof is formed as a connector 50 to connect the circuit board 10. Namely, in this embodiment, the antenna 30 and the circuit board 10 are electrically connected in a cable manner.

Figure 3:
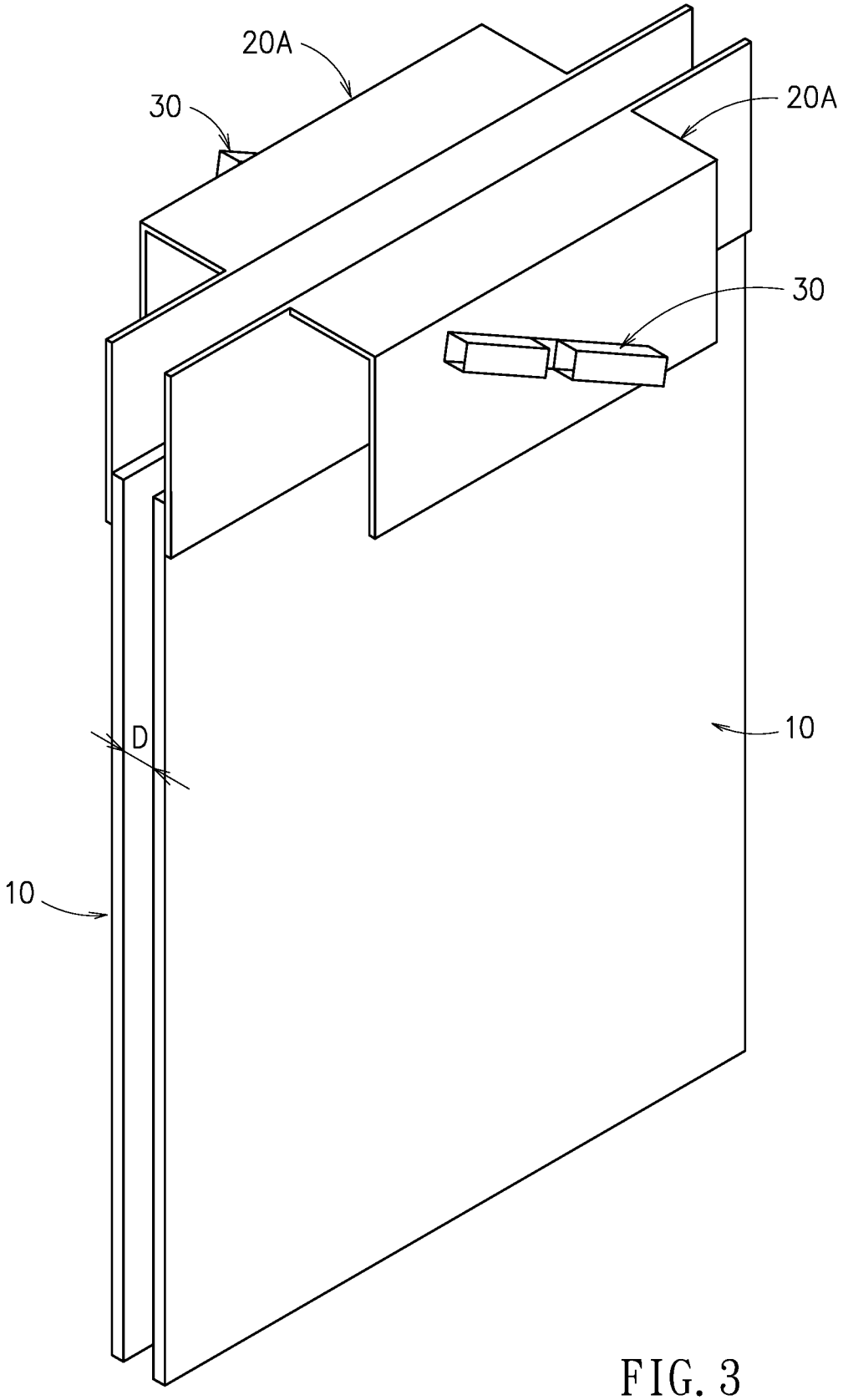
FIG. 3 is a schematic perspective view of a further embodiment of the holder for antennas in accordance with this disclosure, in which two circuit boards and two carriers are included.

Referring now to FIG. 3, in this embodiment, two circuit boards 10, two carriers 20A and two antennas 30 are included. The two neighboring circuit boards 10 are separated by a distance D. Each of the two circuit boards 10 is furnished with one carrier 20A, and each of the two carriers 20A is furnished with one antenna 30. As shown, the antenna 30 and the corresponding circuit board 10 are electrically connected in a wireless manner.

Figure 4:
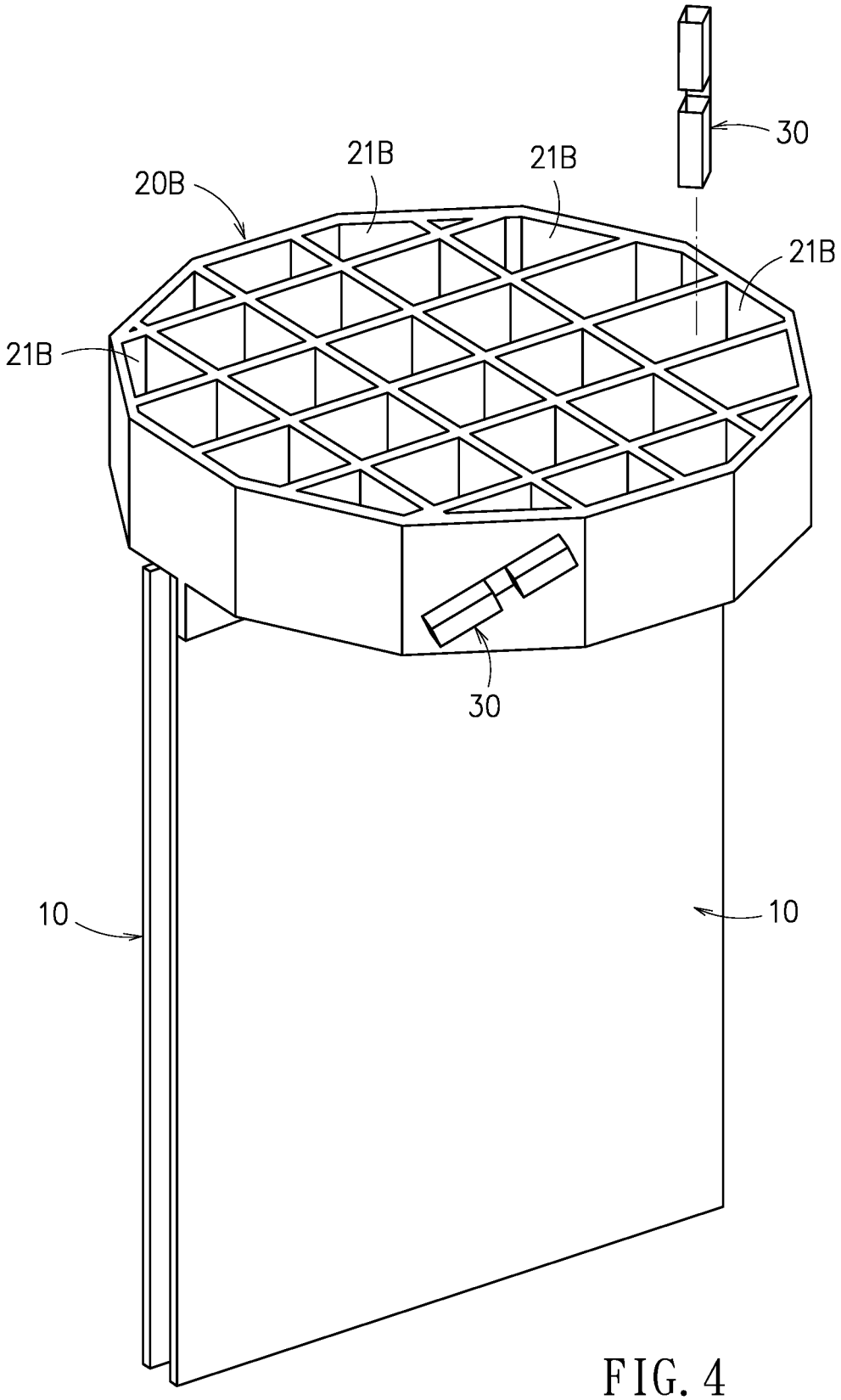
FIG. 4 is a schematic perspective view of one more embodiment of the holder for antennas in accordance with this disclosure, in which two circuit boards and one carrier are included.

Referring now to FIG. 4, in this embodiment, two circuit boards 10, a carrier 20B and a plurality of antennas 30 are included. The two circuit boards 10 use the same carrier 20B. As shown, the carrier 20B, shaped as a polygon, is constructed to have a plurality of honeycomb structures 21B. The antenna 30 can be disposed arbitrarily inside one of the honeycomb structures 21B of the carrier 20B or outside the carrier 20B. The antenna 30 and the corresponding circuit board 10 are electrically in a wireless manner or in a cable manner.

By summarizing embodiments of FIG. 1 through FIG. 4, this disclosure can adopt one or multiple circuit boards. One circuit board can pair a carrier, or multiple circuit boards can use a common carrier. The carrier can be shaped in a regular or irregular geometric configuration. The antenna can be disposed inside the honeycomb structure of the carrier or outside the carrier.

In summary, the holder for antennas provided by this disclosure is formed as a modular structure consisted of the antenna, the carrier and the circuit board, and thereupon is beneficial to be assembled into or disassembled from the casing of the electronic device.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A holder for antennas, comprising:

at least one circuit board;

at least one carrier, shaped as a polygon and disposed to a lateral side of the at least one circuit board, having a plurality of honeycomb structures; and at least one antenna, disposed at the at least one carrier, electrically connected with the at least one circuit board.

2. The holder for antennas of claim 1, wherein the at least one carrier is shaped in a regular or irregular geometric configuration.

3. The holder for antennas of claim 1, wherein the at least one carrier is made of a conductive or non-conductive material.

4. The holder for antennas of claim 1, wherein the at least one antenna is mounted onto the at least one carrier by adhering, laser engraving or printing.

5. The holder for antennas of claim 1, wherein the at least one antenna is electrically connected with the at least one circuit board in a wireless or cable manner.

6. The holder for antennas of claim 1, wherein each of the at least one circuit board is furnished with the at least one the carrier or a plurality of the at least one carrier.

7. The holder for antennas of claim 1, including a plurality of the at least one circuit board, wherein the two neighboring circuit boards are separated by a distance.

8. The holder for antennas of claim 7, wherein the plurality of the at least one circuit board are configured to be connected to the carrier, or each of the plurality of the at least one circuit board is furnished with the at least one carrier or the plurality of the at least one carrier.

* * * * *